US006010227A

United States Patent [19]

Crown et al.

[11] Patent Number: 6,010,227

[45] **Date of Patent: *Jan. 4, 2000**

[54] ACCESSIBLE BALLAST AND BALLAST MOUNTING

[75] Inventors: Charles E. Crown, San Fernando; George Pettit, Palmdale, both of Calif.

[73] Assignee: Anthony, Inc., San Fernando, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/986,201

[22] Filed: Dec. 5, 1997

Related U.S. Application Data

[63] Continuation of application No. 08/483,245, Jun. 7, 1995, Pat. No. 5,720,540.

[51] Int. Cl.[7] ..... F21V 23/02

[52] U.S. Cl. ..... 362/92; 362/260; 362/362; 362/226

[58] Field of Search ..... 362/362, 92, 125, 362/145, 147, 226, 260, 263, 265, 364, 374, 126, 368; 62/249; 312/223.5; 220/346, 802, 326, 332, 340

[56] References Cited

U.S. PATENT DOCUMENTS

| | | |
|---|---|---|
| 2,339,085 | 1/1944 | Luckiesh . |
| 4,220,986 | 9/1980 | Matteo et al. . |
| 4,449,168 | 5/1984 | Ewing . |
| 4,674,015 | 6/1987 | Smith . |
| 4,748,543 | 5/1988 | Swarens . |
| 4,791,539 | 12/1988 | Ewing . |
| 4,870,549 | 9/1989 | Lauckhardt et al. . |
| 5,136,493 | 8/1992 | Straus et al. . |
| 5,146,392 | 9/1992 | Kasboske . |
| 5,440,466 | 8/1995 | Belisle et al. . |
| 5,508,898 | 4/1996 | McGovern . |

*Primary Examiner*—Thomas M. Sember

*Attorney, Agent, or Firm*—Henricks, Slavin & Holmes

[57] ABSTRACT

A ballast can having at least one of an opening which faces in a direction other than toward the rear of the refrigeration unit in which it is mounted and a ballast mounted on the can's cover. The ballast can may include resilient members for attaching the can to a refrigeration unit frame.

31 Claims, 3 Drawing Sheets

10
12
14
16
18
20
22
24
26
28
30
32
34
36
38
40
42
44
46
2
2

ACCESSIBLE BALLAST AND BALLAST MOUNTING

This application is a continuation of U.S. application Ser. No. 08/483,245, filed Jun. 7, 1995, now U.S. Pat. No. 5,720,540.

BACKGROUND OF THE INVENTION

1. Field of Invention

The present invention relates generally to refrigerated display cases and storage units and, more particularly, to a device for housing and mounting components such as ballasts within refrigerated display cases and storage units.

2. Description of the Related Art

Refrigerated display cases are typically found in grocery stores, convenience stores and florist shops. These display cases are used to display products which must be stored at relatively low temperatures and often include shelves, glass doors and/or glass walls to permit viewing of the products supported by the shelves. Refrigerated storage units are typically found in warehouses, restaurants and bars. The storage units typically include shelves and are used to store food, beverages and other items which must be stored at relatively low temperatures. Refrigerated display cases and storage units may be free standing units or "built-in" units that form an actual part of the building in which they are located, such as those found in convenience stores.

Lighting units are typically provided inside refrigerated display cases and storage units for illuminating the items supported by the shelves or otherwise placed therein. When the lighting units include florescent lamps, ballast units are often employed to fire and illuminate the lamps. The ballast is preferably mounted adjacent to, or in the vicinity of, the florescent lamps so as to minimize the length of the conductor required to electrically couple the ballast and the lamp.

Ballasts are normally mounted and retained within a ballast can which includes various wiring fixed in thermoset plastic. The wiring must be connected to the ballast when the ballast is placed into the can. The ballast can is either mounted on, or forms a part of, the refrigerated display case or storage unit's surrounding frame. The surrounding frame is an integral part of stand alone units. In "built-in" units, the frame is mounted within an opening formed in a wall. Ballast cans are typically bulky and, heretofore, the ballast has been secured to the portion of the ballast can which is mounted on, or forms a part of, the surrounding frame. One reason for this mounting arrangement was the misguided belief that such an arrangement was necessary to support the weight of the ballast and ballast can.

Ballast cans typically include an access wall, or door, secured by a clip to insure that the door remains closed during normal use. When prior art ballast cans are mounted on the inside front of a frame, the access wall faces the rear of the display case or storage unit. As a result, a technician who wishes to service or replace the ballast must open the front door of the display case or storage unit, reach inwardly and around the ballast can, open its door, and then service the ballast without making visual contact with it. Alternatively, the technician must reach in from the rear of the unit across one or more shelves to access the ballast can. Often, products and shelves must be removed in order to reach the ballast. Prior art rear access ballast cans are, therefore, normally very difficult to access and service and there is a need for a more easily accessible ballast can.

Another disadvantage associated with prior art ballast cans is related to the fact that such ballast cans are often integral with the frame, or attached to the frame with a series of nuts and bolts. As such, it is impossible or, at a minimum, very difficult, to remove the ballast cans from storage units and display cases for repair or replacement. Installation of ballast cans is similarly difficult.

OBJECT AND SUMMARY OF THE INVENTION

A general object of the present invention is to provide improved ballast cans, refrigerator unit frames and refrigerator units which reduces the aforementioned problems. In particular, one object of the present invention is to provide a ballast can (or a frame or refrigeration unit having a ballast can) which is configured so that it is relatively easy to gain access to the ballast. Another object of the present invention is to provide a ballast can (or a frame or refrigeration unit having a ballast can) which may be easily removed from refrigerated units for service or replacement.

In order to accomplish these and other objectives, one embodiment of a ballast can in accordance with an aspect of the present invention includes an opening which faces in a direction other than toward the rear of the refrigeration unit in which it is mounted. Similarly, respective embodiments of a frame and a refrigeration unit in accordance with present inventions include a ballast can having an opening which faces in a direction other than toward the rear of the refrigeration unit.

Another embodiment of a ballast can in accordance with a present invention includes a resilient member adapted to engage an aperture in a refrigeration unit frame.

Still another embodiment of a ballast can in accordance with a present invention includes a ballast mounted on the can's cover. Similarly, a refrigeration unit frame in accordance with an embodiment of a present invention includes a ballast can having a ballast mounted to its cover.

The above described and many other features and attendant advantages of the present inventions will become apparent as the invention becomes better understood by reference to the following detailed description when considered in conjunction with the accompanying drawings.

BRIEF DESCRIPTION OF THE DRAWINGS

Detailed descriptions of preferred embodiments of the inventions will be made with reference to the accompanying drawings.

DETAILED DESCRIPTION OF THE PREFERRED EMBODIMENTS

The following is a detailed description of preferred embodiments of the present inventions. This description is not to be taken in a limiting sense, but is made merely for the purpose of illustrating the general principles of the inventions. The scope of the inventions is defined by the appended claims.

Figures 1, 2:
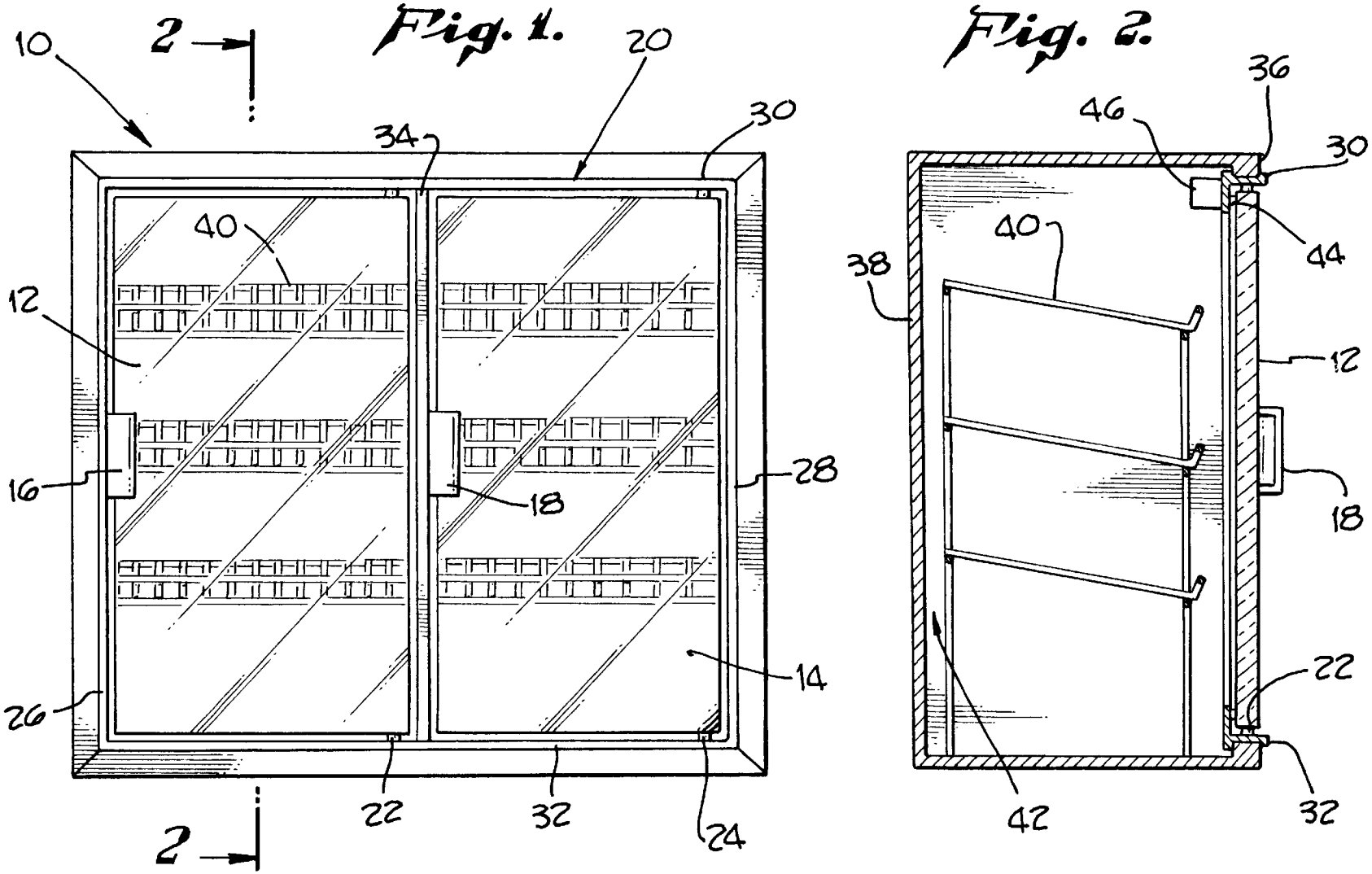
FIG. 1 is a front elevation view of a refrigeration unit.
FIG. 2 is a section view taken along line 2—2 in FIG. 1.

FIG. 1 illustrates one example of a refrigeration unit 10 which may be used in conjunction with, or form an element of, the present inventions. The refrigeration unit may be either a stand alone unit or a "built-in" unit. The refrigeration unit includes a pair of doors 12 and 14 which include handles 16 and 18, respectively. The doors 12 and 14 are pivotally mounted on a frame 20 by hinges 22 and 24. Frame 20 is secured to an opening in the refrigeration unit and consists of a pair of side members 26 and 28, a top member 30 and a bottom member 32. The frame may also include a mullion 34. Although not shown, a wire way may be associated with mullion 34, as well as other elements of frame 20, to provide passage for electrical wiring that is connected to the ballast.

Turning to FIG. 2, exemplary refrigeration unit 10 may also include a front wall 36, a rear wall 38 and a shelving unit 40 disposed therebetween. The shelving unit's shelves may be slightly slanted, as shown, or horizontal. Additionally, the space between shelving unit 40 and rear wall 38 (indicated by reference numeral 42) may be larger than that shown. In particular, space 42 may be large enough to allow a person to pass through. A magnetic gasket-type seal 44 is also provided between the doors 12 and 14 and frame 20 to prevent cold air from escaping from within the refrigeration unit.

In accordance with the illustrated embodiments, a ballast can 46 may be either permanently or removably attached to, or integral with, a portion of frame 20. In the view shown in FIG. 2, the difficulty associated with gaining access to a ballast stored in prior art ballast cans can be easily seen. It is difficult to service the ballast can by reaching into the refrigeration unit, around the ballast can and through an opening on the side of the ballast can facing rear wall 38. As discussed in detail below with reference to FIGS. 3–6, this problem in the art may be overcome by, for example, providing a ballast can opening which faces in a direction other than toward the rear or access to a ballast from anther direction.

It is to be understood that, in accordance with the present inventions, ballast can 46 may be secured to the frame by any number of means. For example, the ballast can may be attached to the frame through the use of hooks, hangers, screws, nut and bolt arrangements, rivets and other mechanical fastening devices. The ballast can may also be attached through the use of soldering, welding, adhesive bonding, and other similar techniques. Magnetic devices may also be used to secure the ballast can to the frame and, as noted above, frame 20 may be constructed with the ballast can 46 as an integral portion thereof.

In order to minimize the aforementioned difficulties associated with installing and removing ballast cans, and as illustrated for example in FIGS. 3–6, a ballast can may be equipped with a plurality of resilient mounting elements or fasteners 48 which are adapted to be inserted into corresponding apertures 50 formed in the frame. In the illustrated embodiment, the end portion 52 of fasteners 48 defines a substantially triangular shape in cross-section. However, it is to be understood that end portions 52 are not limited to that shape and may be configured in any manner which would allow them to be compressed as they pass through apertures 50. For example, end portions 52 may define an angle shape in cross-section, such as those shown on gasket 44 in FIGS. 3–5.

Figure 3:
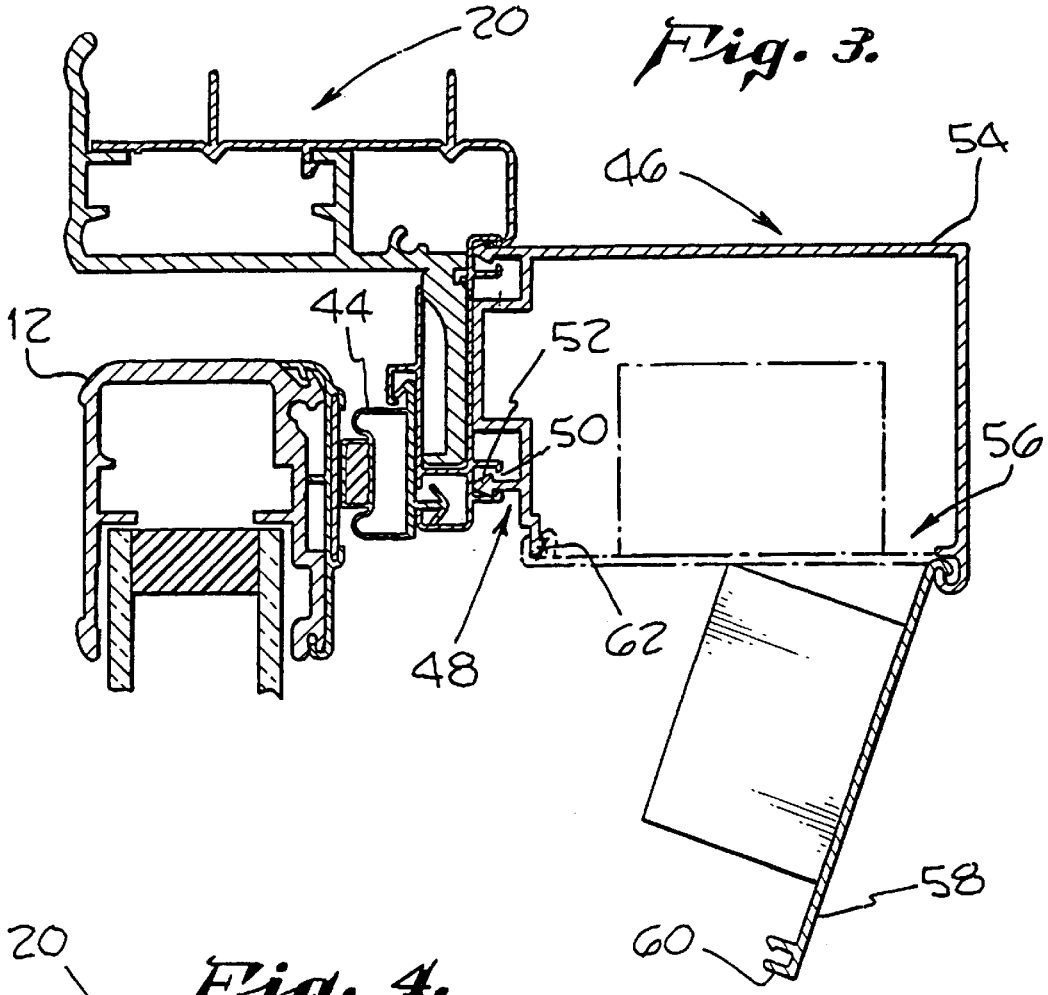
FIG. 3 is a section view of a door, a frame and a ballast can in accordance with aspects of the present inventions.

In accordance with the exemplary configuration shown in FIG. 3, ballast can 46 may include an enclosure 54 having a series of wall members which define a ballast storage space therewithin and an access opening 56. The wall member closest to frame 20 may also be referred to as a support member. A cover 58 may be pivotally or otherwise removably attached to enclosure 54 to cover the opening. One end of cover 58 may be provided with a resilient member 60 which cooperates with a corresponding member 62 on the enclosure. Although not illustrated in the drawings, it is to be understood that the enclosure may include openings which allow electrical connections to be made to and from the ballast.

Ballast cans may be placed within refrigerated units at varying heights depending on the location of the lighting arrangement. Ballast can 46 may be oriented in a number of ways. For example, when the ballast can is positioned in a relatively high location within the refrigeration unit (such as that shown in FIG. 2), it may be oriented in such a manner that access opening 56 faces (and cover 58 opens) downwardly or horizontally. Similarly, if the lighting arrangement within the refrigeration unit necessitates the positioning of the ballast can in a relatively low location, the ballast can may be oriented such that access opening 56 faces (and cover 58 opens) upwardly or horizontally.

Figure 4:
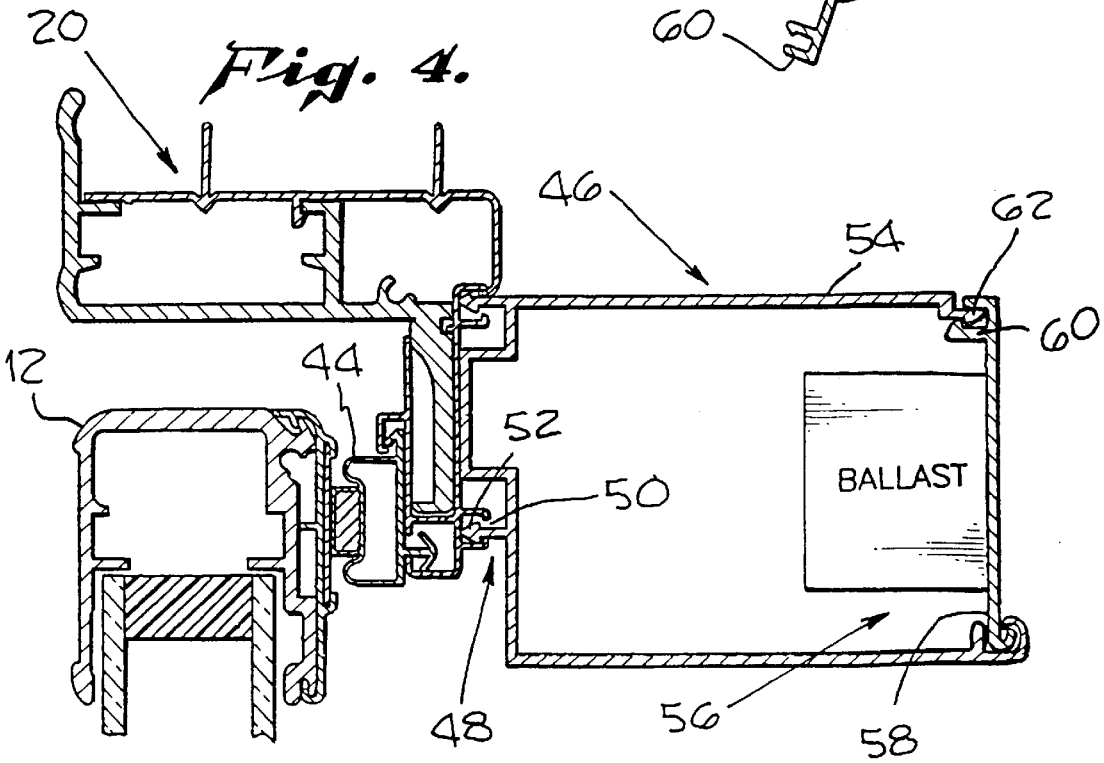
FIG. 4 is a section view of a door, a frame and a ballast can in accordance with aspects of the present inventions.

The position of the opening 56 (and cover 58) is not limited to that shown in FIG. 3. More specifically, when the ballast is mounted on or to the cover, the opening and cover may also be oriented such that they face the rear wall of the refrigeration unit, as shown in FIG. 4. This is because the mounting of the ballast on the cover eliminates the need to reach into the enclosure to access the ballast.

Figure 5:
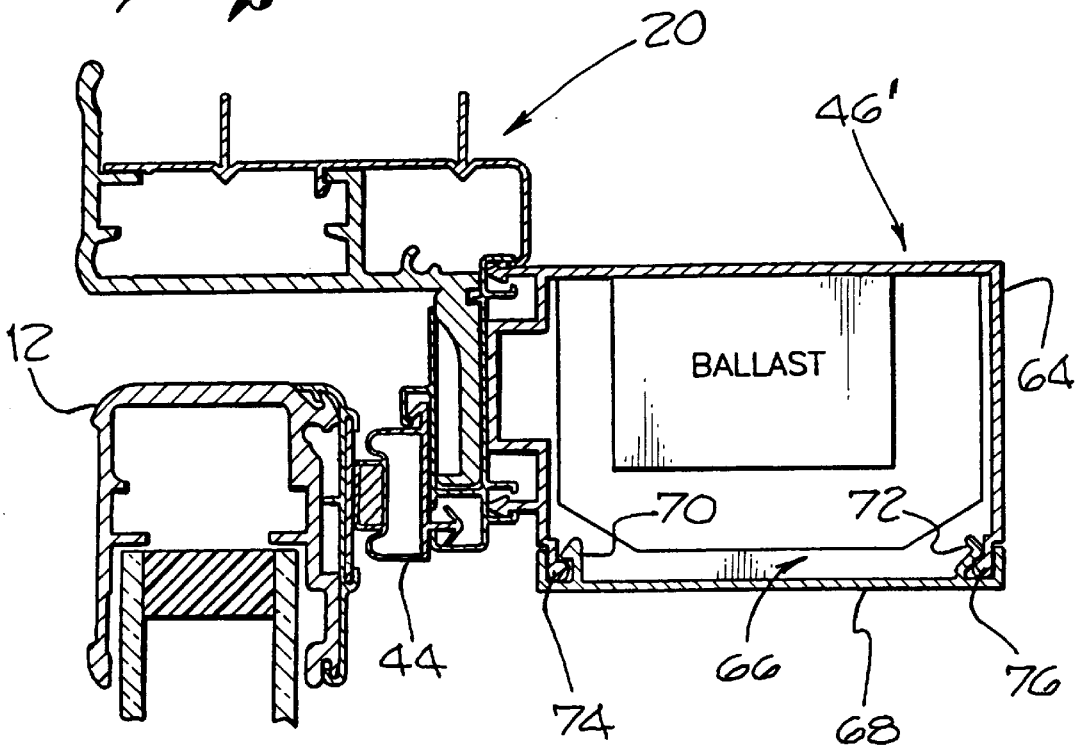
FIG. 5 is a section view of a door, a frame and a ballast can in accordance with aspects of the present inventions.
Figure 6:
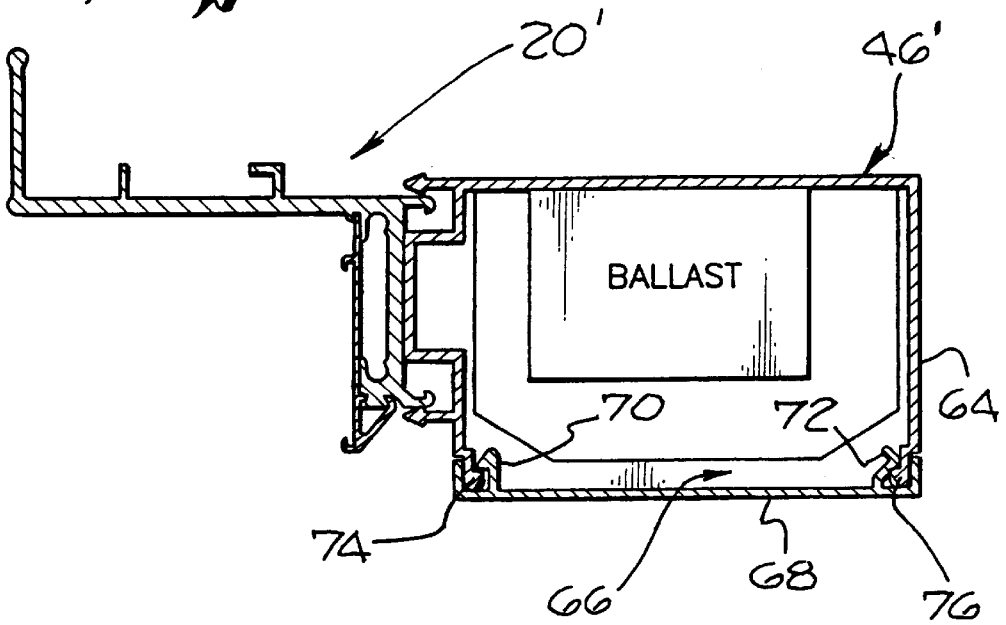
FIG. 6 is a section view of a frame and a ballast can in accordance with aspects of the present inventions.

Referring now to the exemplary configuration shown in FIG. 5, a ballast can 46' may include an enclosure 64 having a series of wall members which define a ballast storage space therewithin and an access opening 66. A cover 68 may be removably attached to enclosure 64 by resilient members 70 and 72 which cooperate with corresponding members 74 and 76, respectively, on the enclosure. As noted above, the ballast can may be oriented in such a manner that access opening 66 faces upwardly, downwardly or horizontally, as the location of the can within the refrigeration unit dictates. Moreover, as illustrated for example in FIG. 6, the ballast can may be integral with, or fixedly secured by means of fasteners, soldering, welding, adhesive bonding and the like to, frame 20'.

Although the present inventions have been described in terms of the preferred embodiments above, numerous modifications and/or additions to the above-described preferred embodiments would be readily apparent to one skilled in the art. It is intended-that the scope of the present inventions extends to all such modifications and/or additions and that the scope of the present inventions is limited solely by the claims set forth below.

I claim:

1. A ballast holder for use with a refrigeration unit, the refrigeration unit including a cold storage compartment defining a rearward area, a structure defining an opening into the cold storage compartment, and at least one door substantially adjacent to the structure, the door having a rearward-most surface defining the forward end of the cold storage compartment, the ballast holder comprising:

a support member having a first side and a second side;

at least one wall member extending outwardly from the support member, the at least one wall member and the first side of the support member defining a ballast storage area; and attachment means for attaching the support member to a portion of the structure within the cold storage compartment such that the first side of the support member does not face the rearward area of the cold storage compartment.

2. A ballast holder as claimed in claim 1, wherein the support member is oriented in a substantially vertical manner when attached to the structure.

3. A ballast holder as claimed in claim 1, wherein the structure defines a side facing in a first direction toward the rearward area and the first side of the support member faces in a second direction which is substantially perpendicular to the first direction.

4. A ballast holder as claimed in claim 1, further comprising a cover for covering the ballast storage area.

5. A ballast holder as claimed in claim 4, wherein the cover is pivotally connected to the at least one wall member.

6. A ballast holder as claimed in claim 4, wherein the cover includes a latching device for maintaining the cover in a closed position.

7. A ballast holder as claimed in claim 6, wherein the latching device includes a resilient member which engages a corresponding member associated with the at least one wall member.

8. A ballast holder as claimed in claim 4, wherein the cover includes a ballast supporting surface.

9. A ballast holder as claimed in claim 4, wherein the support member includes a ballast supporting surface.

10. A ballast holder as claimed in claim 1, wherein the attachment means comprises at least one resilient member adapted to be inserted into an aperture formed in the structure.

11. A ballast holder as claimed in claim 10, wherein the at least one resilient member includes a portion having a substantially triangular cross-section.

12. A ballast holder as claimed in claim 1, wherein the structure includes a frame member and the attachment device is adapted to attach the support member to the frame member.

13. A refrigeration unit, comprising:

an enclosure including a rear wall and a front wall and an inner surface defining a cold storage compartment therewithin;

a structure associated with the front wall and defining an enclosure opening, the structure including a surface facing in a first direction toward the rear wall;

a door associated with the structure for closing the enclosure opening, the door defining an outer surface and an inner-most surface, the inner-most surface of the door defining a forward boundary of the cold storage compartment; and a ballast storage device located inwardly of the inner-most surface of the door including a support member having a first side and a second side, and at least one wall member extending outwardly from the support member, the at least one wall member and the first side of the support member defining a ballast storage area, the support member being attached to a portion of the structure within the cold storage compartment such that the first side of the support member does not face the rearward area of the cold storage compartment.

14. A refrigeration unit as claimed in claim 13, wherein the structure comprises a frame.

15. A refrigeration unit as claimed in claim 14, wherein the frame comprises at least one frame member.

16. A refrigeration unit as claimed in claim 15, wherein the support member is attached to the at least one frame member.

17. A refrigeration unit as claimed in claim 14, wherein the frame comprises at least one frame member and at least one mullion.

18. A refrigeration unit as claimed in claim 13, wherein the support member is oriented in a substantially vertical manner.

19. A refrigeration unit as claimed in claim 13, wherein the first side of the support member faces in a second direction which is substantially perpendicular to the first direction.

20. A refrigeration unit as claimed in claim 13, further comprising a cover for covering the ballast storage area.

21. A refrigeration unit as claimed in claim 20, wherein the cover is pivotally connected to the at least one wall member.

22. A refrigeration unit as claimed in claim 20, wherein the cover includes a ballast supporting surface.

23. A refrigeration unit as claimed in claim 13, wherein the support member includes a ballast supporting surface.

24. A frame and door assembly for use with a refrigeration unit including a cold storage compartment, the refrigeration unit including a rear wall and a front wall defining an enclosure opening having a top region and a bottom region, the assembly comprising:

a plurality of vertically extending frame members and a vertically extending mullion each associated with the enclosure opening and extending from the top region to the bottom region of the enclosure opening, at least one of the vertically extending frame members including a portion facing in a first direction toward the rear wall;

a door covering at least a portion of the enclosure opening and including an inner-most surface defining the forward boundary of the cold storage compartment; and a ballast holder secured to at least one of the vertically extending mullion and vertically extending frame members and located inwardly of the inner-most surface of the door, the ballast holder including a support member facing in a second direction, the second direction being substantially different than the first direction.

25. A frame and door assembly as claimed in claim 24, wherein the second direction is substantially perpendicular to the first direction.

26. A frame and door assembly as claimed in claim 24, wherein the ballast holder further includes a cover.

27. A frame and door assembly as claimed in claim 26, wherein the cover includes a ballast supporting surface.

28. A frame and door assembly as claimed in claim 24, wherein the ballast holder is secured to at least one of the frame members.

29. A frame and door assembly for use with a refrigeration unit, the refrigeration unit including a front wall defining a wall opening, a cold storage compartment, and a rearward area, the assembly comprising:

a plurality of frame members and a mullion located within the cold storage compartment and adjacent the wall opening;

a door covering at least a portion of the wall opening and including an inner-most surface defining the forward boundary of the cold storage compartment; and a ballast storage area located inwardly of the inner-most surface of the door and associated with at least one of the mullion and frame members, the ballast storage area defining an opening, the opening being oriented such that it does not face the rearward area;

a cover for covering the opening; and a ballast secured to the cover.

30. A frame and door assembly as claimed in claim 29, wherein the ballast is removably secured to the cover.

31. A refrigeration unit, comprising:

an enclosure including an inner surface defining a cold storage compartment therewithin;

a frame member having a first wall facing a rear area and a second wall facing a direction substantially different from the rear area and wherein the second wall defines an opening in the frame member and is located within the cold storage compartment;

a door covering at least a portion of the opening and including an inner-most surface defining the forward end of the cold storage compartment; and a ballast holder located inwardly of the inner-most surface of the door for holding a ballast relative to the frame member, the ballast holder including a wall member for covering the opening.

* * * * *